US010663192B2

(12) United States Patent
Carroll

(10) Patent No.: US 10,663,192 B2
(45) Date of Patent: May 26, 2020

(54) VERTICAL VENT STACK CAP

(71) Applicant: Fleming Vaughn Carroll, Clemmons, NC (US)

(72) Inventor: Fleming Vaughn Carroll, Clemmons, NC (US)

( * ) Notice: Subject to any disclaimer, the term of this patent is extended or adjusted under 35 U.S.C. 154(b) by 911 days.

(21) Appl. No.: 13/734,409

(22) Filed: Jan. 4, 2013

(65) Prior Publication Data

US 2014/0194053 A1 Jul. 10, 2014

(51) Int. Cl.
*F24F 13/14* (2006.01)
*F24F 13/20* (2006.01)
*F24F 7/02* (2006.01)

(52) U.S. Cl.
CPC ..... *F24F 13/20* (2013.01); *F24F 7/02* (2013.01); *F23J 2900/13005* (2013.01)

(58) Field of Classification Search
CPC .... F24F 13/20; F24F 7/02; F23J 2900/13005; F23J 2213/50; B65G 51/06; F24L 17/02; F24L 17/12
USPC ..... 454/3, 4, 367
See application file for complete search history.

(56) References Cited

U.S. PATENT DOCUMENTS 510,884 A 12/1893 Bradley, Jr.
687,907 A * 12/1901 Streby ..... B01D 45/14 454/3
1,509,996 A 9/1924 Elting
1,542,740 A 6/1925 Spillman
1,728,494 A 9/1929 Knutson
2,421,705 A * 6/1947 Kasten ..... B01D 46/0021 55/282
2,437,489 A * 3/1948 Vokes ..... F02M 1/00 123/41.33
D154,881 S 8/1949 Rubin
2,488,249 A 11/1949 White
2,524,242 A 10/1950 Weaver
2,531,139 A * 11/1950 Lilly ..... E21B 36/025 126/307 A
2,570,959 A * 10/1951 Lutton ..... F23L 17/10 454/34
2,763,196 A * 9/1956 Singleton ..... F23L 17/02 454/3
2,823,599 A * 2/1958 Still ..... F23L 17/10 454/182
3,031,783 A 5/1962 Burke
3,082,677 A 3/1963 Pease
3,084,704 A * 4/1963 Marx ..... B65D 90/34 137/43
3,488,928 A * 1/1970 Tarala ..... F02M 35/024 55/481

(Continued)

*Primary Examiner* — Vivek K Shirsat
(74) *Attorney, Agent, or Firm* — Kilpatrick Townsend & Stockton LLP

(57) ABSTRACT

A vent cap may include a hollow tube comprising a side wall defining at least one airway; a cap coupled to a first end of the hollow tube, the cap configured to deter one or more unwanted objects from entering the hollow tube through the first end; and a mesh material covering the at least one airway, the mesh material configured to allow air to pass through the at least one airway, the mesh material configured to deter the one or more unwanted objects from entering the hollow tube through the at least one airway. The vent cap may comply with one or more plumbing and/or building codes.

18 Claims, 6 Drawing Sheets

(56) References Cited

U.S. PATENT DOCUMENTS 3,494,114 A * 2/1970 Nelson ..... B01D 46/0024 55/482
3,685,426 A * 8/1972 Rosa ..... F24F 7/02 454/368
4,000,688 A * 1/1977 Malott ..... E04D 13/174 454/365
4,115,961 A 9/1978 Bishop
D254,803 S * 4/1980 Rusth ..... D23/370
4,202,255 A * 5/1980 McNamara ..... F23J 13/08 454/12
4,206,692 A 6/1980 Johnston
4,232,706 A 11/1980 Ericson
4,370,919 A 2/1983 Wagner et al.
4,397,225 A * 8/1983 Patton ..... F23L 17/08 454/368
4,399,743 A 8/1983 Izzi, Sr.
4,548,137 A * 10/1985 Lane ..... F23L 17/02 110/184
4,593,504 A * 6/1986 Bonnici ..... E04D 13/17 454/347
4,616,457 A * 10/1986 Yoder ..... E04H 12/28 138/114
4,624,176 A 11/1986 Steinke
4,627,411 A * 12/1986 Mertler ..... F24C 3/085 126/39 E
4,955,167 A 9/1990 Holtgreve
5,291,707 A * 3/1994 McDonald ..... F23J 13/08 454/3
5,388,729 A * 2/1995 Gerringer ..... A47G 19/14 215/6
D380,038 S 6/1997 Bailey
5,662,522 A * 9/1997 Waltz ..... E04D 13/17 454/359
5,715,808 A * 2/1998 Wilhoite ..... F23L 17/04 126/512
5,816,288 A * 10/1998 Zelch ..... A01K 63/00 137/377
5,876,282 A * 3/1999 Kenny ..... F16L 55/115 138/89.4
6,102,076 A * 8/2000 Romero, Jr. ..... F01N 13/085 138/110
6,152,817 A * 11/2000 Daniels et al. ..... 454/12
6,244,006 B1 * 6/2001 Shue ..... E04D 13/147 52/302.1
D486,891 S 2/2004 Cronce, Jr.
6,735,790 B1 * 5/2004 Willson ..... E03C 1/12 4/218
6,805,627 B2 * 10/2004 Marts ..... F24F 13/082 454/367
6,926,600 B1 * 8/2005 Arnold, Jr. ..... F23J 13/08 454/12
D606,186 S 12/2009 Routh
D618,784 S 6/2010 Underwood
D642,669 S 8/2011 Cheek
8,136,548 B2 3/2012 Trueb
8,209,923 B1 * 7/2012 Rich ..... E04D 13/1476 285/42
8,246,430 B1 * 8/2012 Paynton ..... F23J 13/08 454/3
D677,375 S * 3/2013 Arnold, Jr. ..... D23/373
8,574,045 B2 * 11/2013 Warner ..... E03B 11/08 138/32
2003/0110554 A1 * 6/2003 Hernandez ..... E03C 1/122 4/218
2005/0227610 A1 * 10/2005 Zukor ..... F16K 24/04 454/339
2007/0112068 A1 * 5/2007 Oohira ..... A01N 37/34 514/526
2007/0167130 A1 * 7/2007 Brochu ..... F24F 7/02 454/365
2007/0202790 A1 * 8/2007 Burns ..... F23L 17/04 454/4
2008/0009233 A1 * 1/2008 Leseman ..... B63J 2/04 454/4
2008/0070491 A1 * 3/2008 Howard ..... F23L 17/14 454/3
2008/0207105 A1 * 8/2008 Huta ..... F23L 17/02 454/4
2008/0254729 A1 * 10/2008 Stubbert ..... F23J 13/02 454/3
2008/0256883 A1 * 10/2008 Fleckenstein ..... F23L 17/02 52/244
2009/0088060 A1 * 4/2009 Arnold, Jr. ..... B01D 53/864 454/4
2010/0095846 A1 * 4/2010 Skirius ..... B01D 39/1623 95/285
2011/0275307 A1 * 11/2011 McIver ..... 454/367
2011/0294412 A1 * 12/2011 Vagedes ..... F24F 7/02 454/242
2011/0302876 A1 * 12/2011 Giffin ..... F24F 7/02 52/741.4
2011/0312260 A1 * 12/2011 Cox ..... F23J 13/08 454/4
2012/0198870 A1 * 8/2012 Erbs ..... F25C 1/12 62/126
2012/0318147 A1 * 12/2012 Gates ..... B01D 53/0407 96/154
2013/0165038 A1 * 6/2013 Railkar ..... E04D 13/176 454/365
2013/0189915 A1 * 7/2013 Hazard ..... F23J 13/02 454/47
2016/0252247 A1 * 9/2016 Thomas ..... F23J 13/08 454/4

* cited by examiner

VERTICAL VENT STACK CAP

FIELD OF THE INVENTION

The present disclosure relates generally to vertical vent stack caps.

BACKGROUND

The diameter of many traditional vent caps may not meet various plumbing/building code requirements. For example, a vent cap may restrict air flow into and/or out of the vent stack in violation of plumbing/building code requirements. In addition, many vent caps do not prevent insects and/or other animals such as birds or squirrels from entering the vent pipe and obstructing at least a portion of the vent pipe by, for example, building a nest or the animal itself becoming lodged in the vent pipe. Still other vent caps are not aesthetically pleasing and/or are not cost effective. Accordingly, there is a need for a vent cap that meets various plumbing/building code requirements, prevents insects from entering and/or obstructing the vent pipe, provides an aesthetically pleasing appearance, and/or is cost effective. Vent caps disclosed herein in various embodiments meet one or more of these objectives.

SUMMARY

Embodiments of the present disclosure provide a vent cap comprising: a hollow tube comprising a side wall defining at least one airway; a cap coupled to a first end of the hollow tube, the cap configured to deter one or more unwanted objects from entering the hollow tube through the first end; and a mesh material covering the at least one airway, the mesh material configured to allow air to pass through the at least one airway, the mesh material configured to deter the one or more unwanted objects from entering the hollow tube through the at least one airway.

One embodiment comprises a method of manufacturing a vent cap comprising: providing a hollow tube comprising a side wall defining at least one airway; coupling a cap to a first end of the hollow tube, the cap configured to deter one or more unwanted objects from entering the hollow tube through the first end; and inserting a mesh material into the hollow tube such that the mesh material covers the at least one airway, the mesh material configured to allow air to pass through the at least one airway, the mesh material configured to deter the one or more unwanted objects from entering the hollow tube through the at least one airway.

One embodiment comprises a system comprising: a vent stack having a first diameter; and a vent cap comprising: a hollow tube having a second diameter, the hollow tube comprising a first end, a second end opposite the first end, and a side wall defining at least one airway; a cap coupled to the first end of the hollow tube; and a mesh material covering the at least one airway, wherein the cap is configured to deter one or more foreign materials, such as insects, animals, or other objects, from entering the hollow tube through the first end, wherein the mesh material is configured to allow air to pass through the at least one airway, wherein the mesh material is configured to deter the one or more foreign materials, such as insects, animals, or other objects, from entering the hollow tube through the at least one airway, wherein the second end of the vent cap is configured to be affixed to the vent stack having the first diameter, wherein the second diameter of the vent cap is greater than or equal to the first diameter of the vent stack, and wherein the vent cap is configured to deter the one or more foreign materials, such as insects, animals, or other objects, from entering the vent stack when the second end of the hollow tube is affixed to the vent stack.

These illustrative embodiments are mentioned not to limit or define the disclosure, but rather to provide examples to aid understanding thereof. Illustrative embodiments are discussed in the Detailed Description, which provides further description of the invention. Advantages offered by various embodiments of this disclosure may be further understood by examining this specification.

BRIEF DESCRIPTION OF THE DRAWINGS

The accompanying drawings, which are incorporated into and constitute a part of this specification, illustrate one or more examples of embodiments and, together with the description of example embodiments, serve to explain the principles and implementations of the embodiments.

DETAILED DESCRIPTION

Figure 1:
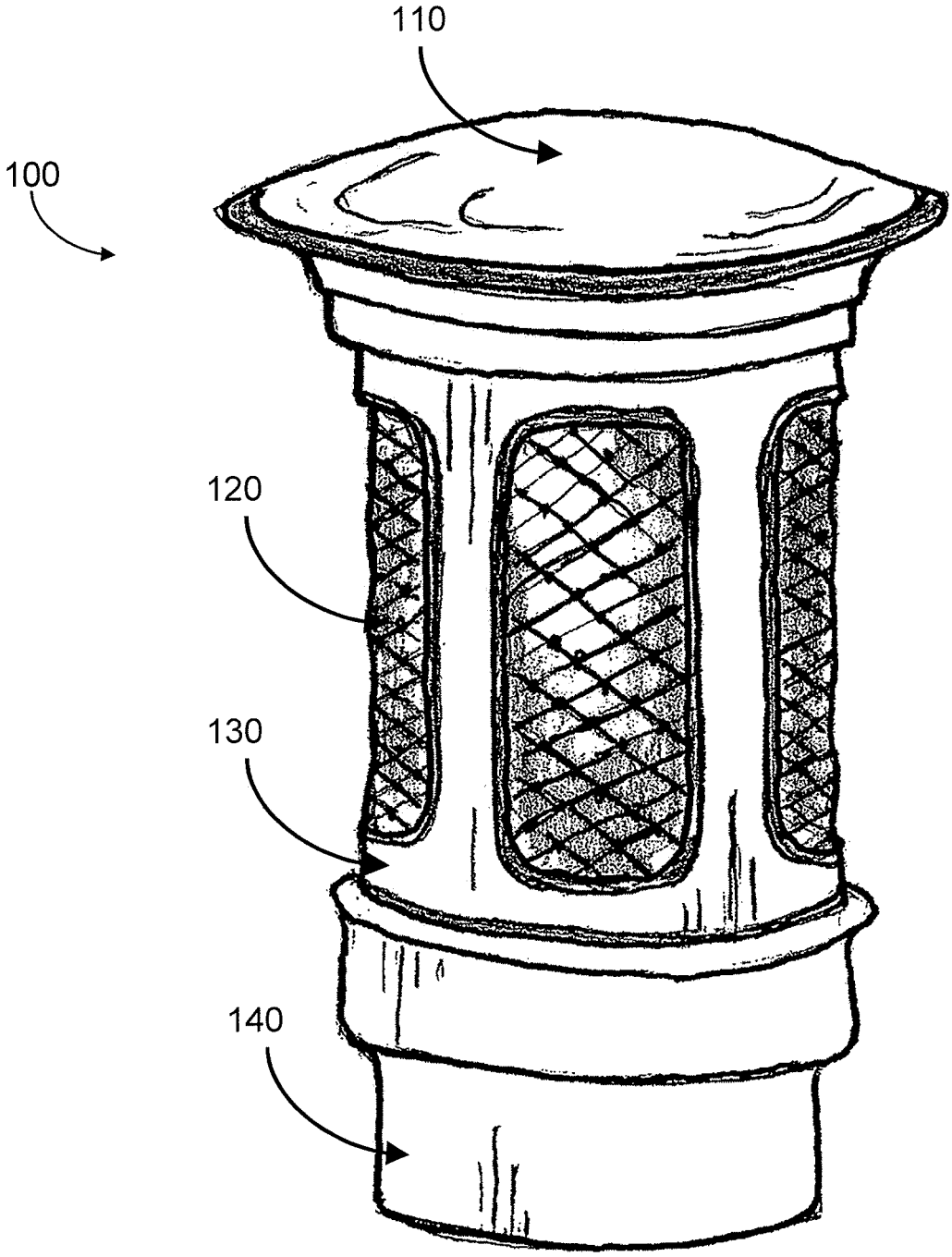
FIG. 1 illustrates a vent cap in accordance with an embodiment of the present disclosure.

Example embodiments are described herein in the context of a vertical vent stack cap. Those of ordinary skill in the art will realize that the following description is illustrative only and is not intended to be in any way limiting. Other embodiments will readily suggest themselves to such skilled persons having the benefit of this disclosure. Reference will now be made in detail to implementations of example embodiments as illustrated in the accompanying drawings. The same reference indicators will be used throughout the drawings and the following description to refer to the same or like items.

In the interest of clarity, not all of the routine features of the implementations described herein are shown and described. It will, of course, be appreciated that in the development of any such actual implementation, numerous implementation-specific decisions must be made in order to achieve specific goals—such as compliance with plumbing/building codes, business-related constraints, and/or other constraints—and that these specific goals will vary from one implementation to another.

Illustrative Embodiments of a Vertical Vent Stack Cap

In an embodiment, a vent cap is a protective vent cap assembly configured to be attached onto the top of a vent stack. For example, the vent cap may be attached onto the top of a soil and waste drain vent stack that passes through the roof of a home, building, or other structure. For example, a vent for one or more drain lines in the home. In some embodiments, the vent cap comprises a pipe configured to connect to the top of a vent stack. In such an embodiment, the pipe comprises one or more airways along its sidewalls. In some embodiments, the vent cap comprises mesh covering the one or more airways. Furthermore, in some embodiments, the pipe comprises a lid configured to cover the end of the pipe that is not connected to the top of the vent stack.

In some embodiments, the vent cap is configured to not obstruct airflow into and/or out of the vent cap and/or the vent stack to which the vent cap is attached. For example, in some embodiments, the vent cap complies with at least certain plumbing codes, for instance, plumbing codes that require a minimum available airflow at the vent stack. Thus, the vent cap may comply with the current Uniform Plumbing Code (UPC) and/or the current International Plumbing Code (IPC). For example, in one embodiment, the area of the one or more airways in the vent cap may be greater than or equal to one-half the diameter of the building drain line served by the vent stack and/or no smaller than the vent stack interior diameter itself Furthermore, in some embodiments, the airway may be of a size that, after subtracting the area of a mesh covering the airway, the airway is still greater than or equal to one-half the diameter of the building drain line of the vent stack. Thus, for example, in some embodiments, the vent stack cap creates no or substantially no obstruction to air flow into or out of the vent stack. Further, in some embodiments the diameter of a portion of the vent cap that is configured to be affixed to a vent stack may be greater than or equal to one-half the diameter of the building drain line of the vent stack. In some embodiments, the diameter of other components of the vent cap, such as the diameter of other pipes or connectors, is at least the diameter of the portion of the vent cap that is configured to be affixed to the vent stack.

Furthermore, in some embodiments, the vent cap is configured to prevent obstructions from forming in the vent stack, vent cap, and or the airways of the vent cap. For example, the vent cap may be configured to prevent insects and/or other animals such as snakes, birds, lizards, mice, rats, or rodents from entering a vent stack. In further embodiments, the vent cap is configured to prevent insects and/or other animals from building a nest and/or other structures inside the vent stack and/or on the exterior of the vent stack and/or on or in the airways of the vent cap. In still other embodiments, the vent cap is configured to prevent other objects that may be placed by vandals from entering the vent stack, e.g. cans, bottles, cigarette butts etc. In still other embodiments, the vent cap is configured to prevent plant material, such as leaves, seeds, twigs, flowers, or other plant material from entering the vent stack.

In some embodiments, the airway(s) of the vent cap does not comprise any ninety-degree angles. In some embodiments, this may deter insects, such as wasps, mud-daubers, from building a nest in or on the airway. In other embodiments, a vent cap may contain ninety-degree angles. As another example, a cap component of a vent cap may contain a curved lip around the perimeter of the cap. In such an embodiment, the curved lip may deter insects and/or other animals from building a nest and/or other structures inside the vent stack and/or on the exterior of the vent stack and/or on or in the airways of the vent cap. For example, some insects are better able to build a nest or other structure in a corner that is at substantially a 90 degree angle. Thus, in some embodiments, incorporating rounded lips or edges and/or avoiding 90-degree angles in construction discourages insects and other animals from building nests and other structures in or around a vent cap of the present disclosure.

In some embodiments, the one or more of the airways may be covered with a mesh material that helps to deter insects, animals, and/or other unwanted objects from entering the vent cap through the airways. In some embodiments, this mesh material may be a material configured to resist or deter insects from building nests or other structures in the mesh. In some embodiments, the mesh material may have been treated with a pesticide or other substance to resist or prevent insects from building nests or other structures in the mesh. In some embodiments, the mesh material may be a separate component, such as a separate wire mesh insert, or may be integrated into the hollow tube. The mesh material is configured to allow air to flow substantially unobstructed into and/or out of one or more airways defined by the hollow tube.

This illustrative example is given to introduce the reader to the general subject matter discussed herein. The disclosure is not limited to this example. The following sections describe various additional non-limiting embodiments and examples of vent caps.

Illustrative Vent Cap

Figure 2:
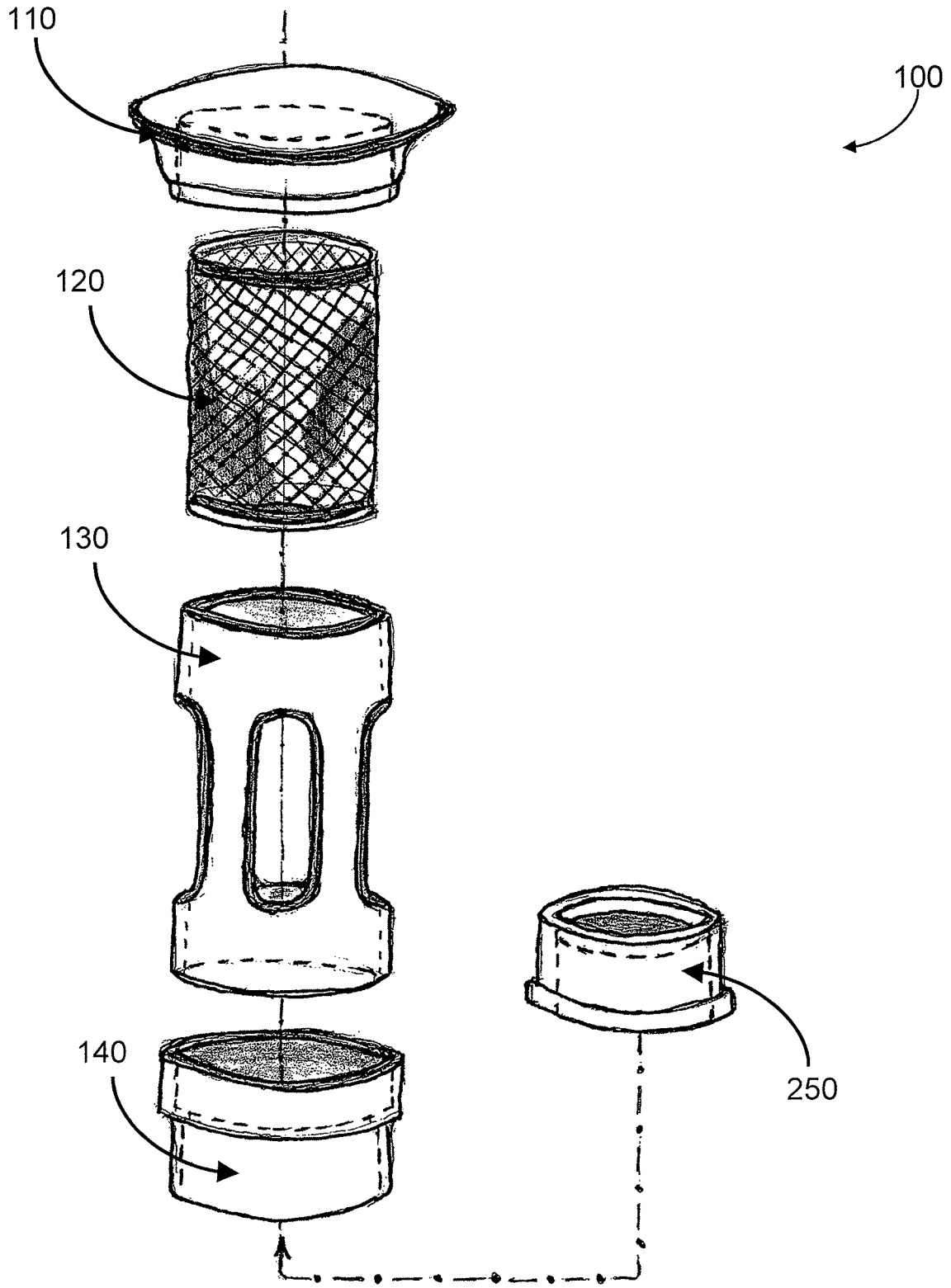
FIG. 2 illustrates an exploded view of the vent cap shown in FIG. 1 in accordance with an embodiment of the present disclosure.

Referring to FIG. 1, this figure illustrates a vent cap 100 in accordance with an embodiment of the present disclosure. FIG. 2 illustrates an exploded view of the vent cap 100 shown in FIG. 1 in accordance with an embodiment of the present disclosure. The vent cap 100 shown in FIGS. 1 and 2 includes a cap 110, wire mesh material 120, hollow tube 130, and connector pipe 140. The vent cap 100 may be installed on top of a vent stack. For example a vent stack associated with plumbing vents, such as drain vents or vents for waste lines. Thus, the connector pipe 140 may fit over or otherwise connect with a vent stack pipe. In some embodiments, a vent cap 100 may include a reduction or expansion connector, for example, reduction connector 250 shown in FIG. 2. In some embodiments, one or more reduction or expansion connectors can be configured such that a vent cap can be connected with vent stacks of varying diameters. For example, in some embodiments, a vent stack according to the present disclosure may comprise an inner diameter of 1.5", 2", 2.5", 3", 4" or another diameter. Further, in some embodiments, a vent stack cap according to the present disclosure may comprise a UV-inhibitor, for example, a paint configured to resist UV-rays and therefore increase the lifetime of the material of the vent stack cap. In some embodiments, a vent stack cap of the present disclosure may comprise a texture configured to allow paint to easily adhere to one or more surfaces of the vent stack cap. In some embodiments, a vent stack cap of the present disclosure may comprise material configured to be UV resistant, for example, in some embodiments, the cap may comprise a UV resistant or stabilizing material. In some embodiments, a vent stack cap of the present disclosure may comprise a material or texture recommended or approved by the AAMA (American Architectural Manufacturers Association). In still other embodiments, a vent stack cap of the present disclosure may comprise a material configured to prevent or slow corrosion. For example, in some embodiments a vent stack cap may utilize a component to allow for dielectric coupling.

In the embodiment shown in FIGS. 1 and 2, the vent cap 100 is a protective vent cap assembly configured to be attached onto the top of a vent stack. For example, the vent cap 100 may be attached onto the top of a soil and waste drain vent stack that passes through the roof of a building, such as a house, residential building, apartment building, condo building, commercial building, or other building with plumbing vents.

The vent cap 100 shown in FIGS. 1 and 2 comprises a hollow tube 130. For example, the hollow tube 130 may be a pipe, such as a hollow cylinder or hollow rectangle. The hollow tube 130 can be constructed using any number of materials. In one embodiment, the hollow tube 130 is made of polyvinyl chloride (PVC). The hollow tube 130 can be made of acrylonitrile butadiene styrene (ABS), polyvinyl chloride (PVC), glass, metal, recycled plastics, resins, other plastic(s), another suitable material, or a combination thereof. In one embodiment, the hollow tube 130 comprises a side wall defining at least one airway. For example, the hollow tube 130 shown in FIG. 2 comprises at least four airways, three of which are visible in the figure. The hollow tube 130 can include a side wall that defines any number of airways. In one embodiment, the hollow tube 130 comprises a side wall that defines a single airway. In other embodiments, the hollow tube 130 comprises a side wall that defines two, three, four, or more airways. The airways may be spaced dimensionally apart in the side wall of the hollow tube 130. For example, each airway may be the same, or substantially the same, distance apart from a neighboring airway. In one embodiment, and as shown in FIG. 2, one or more airways are curved such that hollow tube 130 does not comprise a right angle. For example, in one embodiment, the opening for the airways are cut or moulded to form rounded openings. In other embodiments, one or more airways may comprise right angles. Numerous other embodiments are disclosed herein and variations are within the scope of this disclosure.

In some embodiments, the hollow tube 130 is coupled with a cap 110. The cap 110 can be constructed using any number of materials. In one embodiment, the cap 110 is made of polyvinyl chloride (PVC). The cap 110 can be made of acrylonitrile butadiene styrene (ABS), polyvinyl chloride (PVC), glass, metal, recycled plastics, resin(s), other plastic(s), a metal, another suitable material, or a combination thereof. In one embodiment, the cap 110 is designed such that a first end of the hollow tube 130 fits inside a portion of the cap 110. The cap 110 may comprise a mushroom shape design. In one embodiment, the cap 110 does not comprise a right angle. For example, a lip of the cap 110 may comprise a rounded or otherwise curved perimeter. In other embodiments, the cap 110 may comprise one or more right angles. The cap 110, when coupled to the hollow tube 130, may prevent one or more unwanted objects from entering the vent cap 100 through an end of the hollow tube 130 to which the cap 110 is coupled. The cap 110 may be a separate component from the hollow tube 130. In some embodiments, the cap 110 and the hollow tube 130 comprise a single molded component. For example, in one embodiment, cap 110 and hollow tube 130 may comprise a single extruded component. In such an embodiment, the screen may further be a part of the extruded component, thus in some embodiments, a vent cap of the present disclosure may comprise a single component. In other embodiments the cap 110 and the hollow tube 130 comprise separate components configured to be assembled. For example, the cap 110 and the hollow tube 130 may comprise components that are coupled to each other via one or more friction fittings. In some embodiments, the cap 110 and the hollow tube 130 may comprise components that are coupled to each other via one or more solvent welds. Numerous other embodiments are disclosed herein and variations are within the scope of this disclosure.

In some embodiments, one or more mesh materials are used in vent cap 100. For example, one or more mesh materials may cover one or more airways in the vent cap 100. As shown in the embodiment shown in FIG. 1, a mesh material 120 covers the airways defined by the hollow tube 130. The mesh material 120 may be any suitable material. For example, the mesh material may be a wire mesh, a plastic mesh, parallel bars dimensionally spaced within one or more of the airways defined by the hollow tube, horizontal bars dimensionally spaced within one or more of the airways defined by the hollow tube, other suitable materials, other suitable designs, or a combination thereof. The mesh material 120 may allow air to flow through the gaps in the mesh. Thus, in one embodiment, air can flow through one or more of the airways defined by the hollow tube when the mesh is connected with or otherwise affixed to the hollow tube. In an embodiment, any airway restrictions by the mesh are calculated in sizing of any required airway openings for the vent cap.

In some embodiments, the mesh material may be a separate component of a vent cap. For example, a wire mesh cylinder may be inserted into the hollow tube such that the wire mesh cylinder covers at least one airway defined by the hollow tube. In other embodiments, the mesh material may be an integrated component. For example, the hollow tube 130 and the mesh material 120 may be a single component. The mesh material 120 may made of the same material as the hollow tube. Alternatively, the mesh material 120 can comprise one or more materials different than the material(s) used to make the hollow tube 130.

In some embodiments, the hollow tube 130 is coupled with a connector pipe 140. The connector pipe 140 can be constructed using any number of materials. In one embodiment, the connector pipe 140 is made of polyvinyl chloride (PVC). The connector pipe 140 can be made of acrylonitrile butadiene styrene (ABS), polyvinyl chloride (PVC), glass, metal, other plastic(s), another suitable material, or a combination thereof. In one embodiment, the connector pipe 140 is designed such that a second end of the hollow tube 130 fits inside a portion of the connector pipe 140. In one embodiment, the connector pipe 140 does not comprise a right angle. In other embodiments, the connector pipe 140 may comprise one or more right angles. For example, angles produced as a result of a molding process may comprise right or other angles. The connector pipe 140, when coupled to the hollow tube 130 and a vent stack, may prevent one or more unwanted objects from entering the vent cap 100 through an end of the hollow tube 130 to which the connector pipe 140 is coupled. The connector pipe 140 may be a separate component from the hollow tube 130. In some embodiments, the connector pipe 140 and the hollow tube 130 comprises a single molded component. Numerous other embodiments are disclosed herein and variations are within the scope of this disclosure.

In one embodiment, the vent cap 100 complies with at least certain plumbing codes. For example, in an embodiment, the diameter of the connector pipe 140 of the vent cap 100 is such that it is greater than or equal to one-half the diameter of the building drain line it serves. The vent cap may comply with the current Uniform Plumbing Code (UPC). In some embodiments, the diameter of other components of the vent cap 100, such as hollow tube 130 and connector pipe 140, are at least the diameter of the connector pipe 140. Thus, in some embodiments, the diameter of each of the components of the vent cap 100 may have a diameter that is greater than or equal to one-half the diameter of the line it is designed to serve.

In one embodiment, the vent cap 100 is designed to prevent insects and/or other animals from entering a vent stack. The vent cap 100 shown in FIG. 1 may help to prevent insects and/or other animals from building a nest and/or other structure inside the vent stack cap 100 and/or on the exterior of the vent stack cap 100 because of its design features. For example, in one embodiment, the vent cap 100 does not contain any ninety-degree angles. In other embodiments, the vent cap 100 may contain ninety-degree angles. As another example, cap 110 may contain a curved lip around the perimeter of the lid 110. In the embodiment shown in FIG. 1, the pipe has a side wall that defines several airways. A hollow tube, such as pipe 130, can have a side wall that defines one or more airways. In this embodiment, one or more of the airways of the hollow tube, such as pipe 130, is covered with a mesh material 120 that helps to prevent insects, animals, or other unwanted objects from entering the vent cap 100 through the airways. The mesh material 120, such as a separate or integrated wire mesh, can allow air to flow into and/or out of pipe 130. Further, in some embodiments, the mesh material may be a material configured to resist or prevent insects from building nests or other structures in the mesh. In some embodiments, the mesh material may have been treated with a pesticide or other substance to resist or prevent insects from building nests or other structures in the mesh.

In one embodiment, mesh material 120 may be part of a mesh assembly. In such an embodiment, the mesh assembly may comprise a single rounded piece of mesh material configured to be inserted into the hollow tube above. Further, in some embodiments, the mesh assembly may further comprise one or more bearing surfaces configured to allow the mesh assembly to rotate in pipe 130. In some embodiments, this rotation may be configured to resist or prevent insects from building nests or other structures in the mesh, or on other components of the vent stack cap. Further, in one embodiment, the mesh assembly may comprise a wind-mill or wind-vane configured to catch wind blowing over mesh assembly and cause the mesh assembly to rotate, thus discouraging the presence and nesting of insects or other animals, such as birds, lizards, and/or rodents.

In the embodiment shown in FIG. 2, reduction fitting 250 is a pipe that is dimensionally sized to fit onto or into connector pipe 140 and to reduce the diameter of the opening. Various reduction fittings having varying interior diameters may be used to connect the vent cap 100 with different vent stacks. For example, a first reduction fitting may be used to connect the vent cap with a first vent stack having a first diameter and a second reduction fitting may be used to connect the vent cap with a second vent stack having a second diameter different from the first diameter. Numerous other embodiments are disclosed herein and variations are within the scope of this disclosure.

Figure 3:
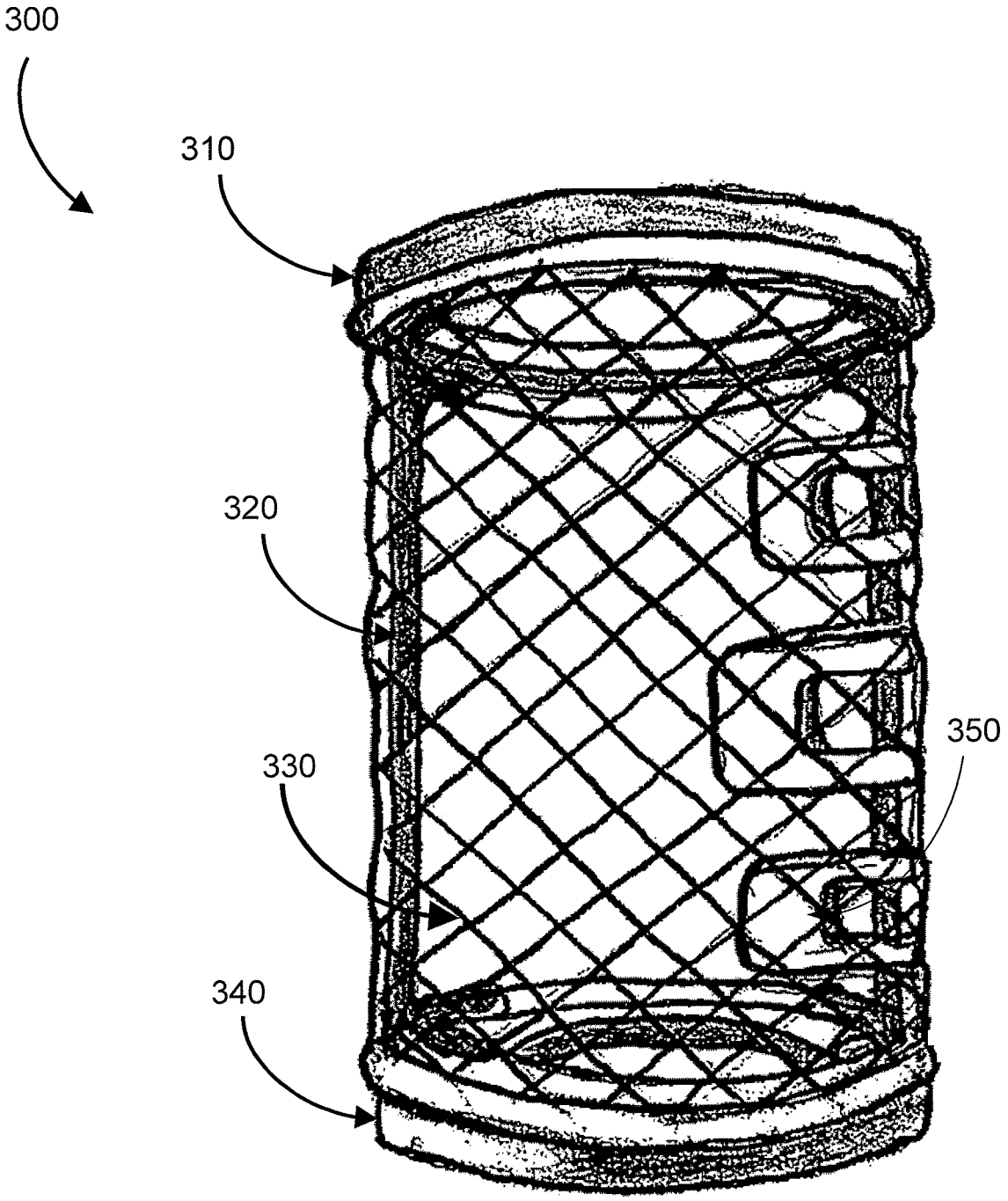
FIG. 3 illustrates a portion of a vent cap in accordance with an embodiment of the present disclosure.
Figure 4:
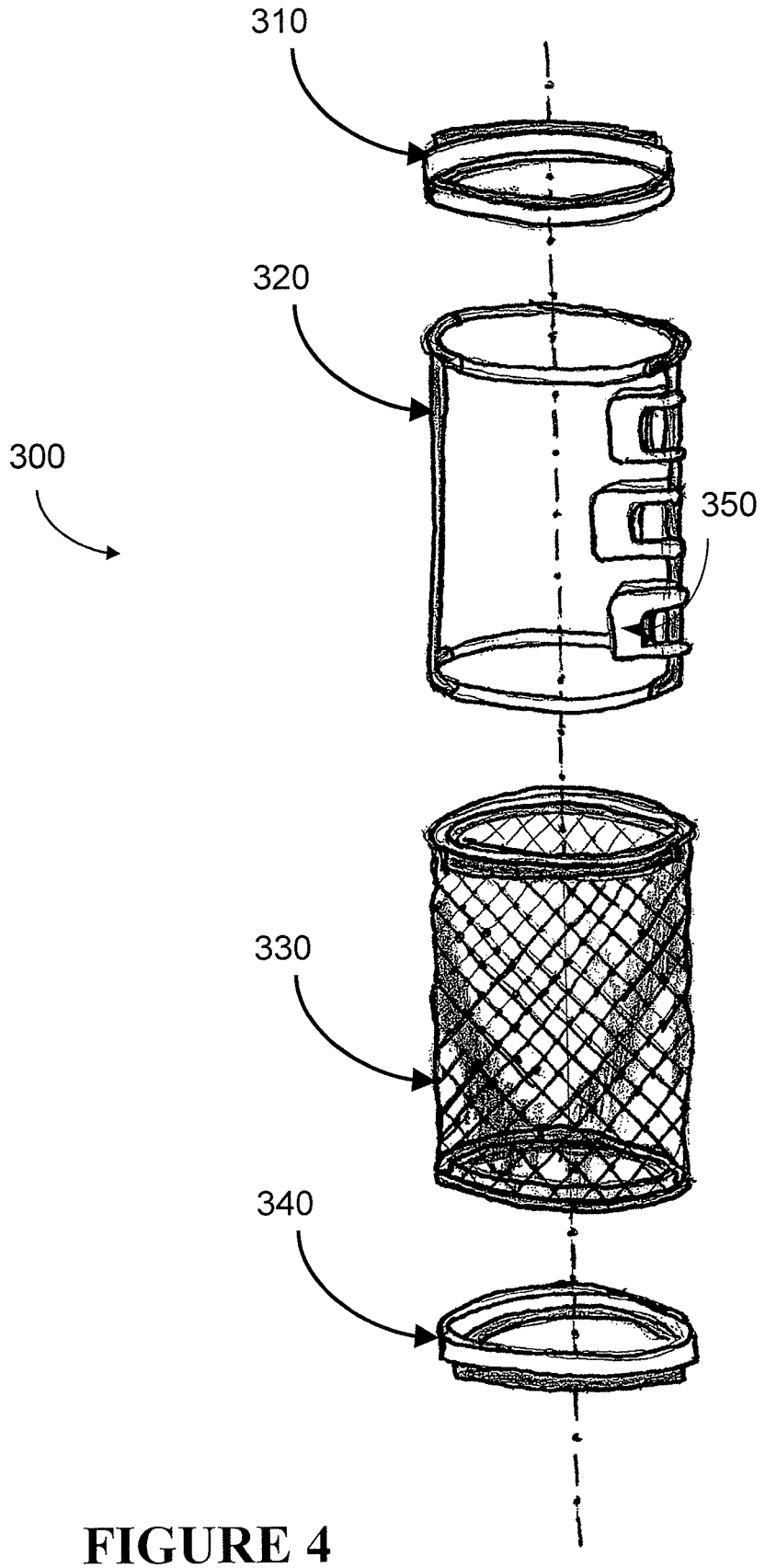
FIG. 4 illustrates an exploded view of the portion of the vent cap shown in FIG. 3 in accordance with an embodiment of the present disclosure.

Referring to FIG. 3, this figure illustrates a portion of a vent cap 300 in accordance with an embodiment of the present disclosure. FIG. 4 illustrates an exploded view of the portion of the vent cap 300 shown in FIG. 3 in accordance with an embodiment of the present disclosure. The vent cap 300 shown in FIGS. 3 and 4 includes a top ring 310, a frame 320, a wire mesh insert 330, and a bottom ring 340. In FIG. 3, the top ring 310 is coupled with the frame 320. The frame 320 can be coupled with a bottom ring 340. The portion of the vent cap 300 can be coupled with a cap, such as vent cap 110 shown in FIG. 1. The portion of the vent cap 300 and/or a completed vent cap, such as vent cap 100 shown in FIG. 1, can be affixed to a vent stack.

The portion of the vent cap 300 shown in FIGS. 3 and 4 comprises an frame 320. The frame 320 may be a hollow tube. For example, the frame 320 may be a pipe. The frame 320 can be constructed using any number of materials. In one embodiment, the frame 320 is made of polyvinyl chloride (PVC). The frame 320 can be made of acrylonitrile butadiene styrene (ABS), polyvinyl chloride (PVC), glass, metal, recycled plastic(s), resin(s), other plastic(s), another suitable material, or a combination thereof. In one embodiment, the frame 320 comprises a side wall defining at least one airway. For example, the frame 320 shown in FIGS. 3 and 4 comprises at least one airway. The frame 320 can include a side wall that defines one, two, three, four, or more airways. The airways may be spaced dimensionally apart in the side wall of the frame 320. For example, each airway may be the same, or substantially the same, distance apart from a neighboring airway. In one embodiment, frame 320 supports wire mesh 330 against bearing surfaces 310, 340 and/or vanes 350.

One or more airways may be covered such that air can flow into and/or out of the vent cap. For example, referring to FIG. 3, frame 320 defines at least one airway. The at least one airway shown in FIG. 3 is covered with a wire mesh insert 330. The wire mesh insert 330 can prevent one or more unwanted objects from entering the vent cap through the at least one airway. The wire mesh insert 330 may allow air to flow into and/or out of the at least one airway defined by the frame 320. In some embodiments, the vent cap, when installed, may prevent one or more unwanted objects from entering the vent stack and/or the vent cap. Numerous other embodiments are disclosed herein and variations are within the scope of this disclosure.

In some embodiments, the portion of vent cap 300 further comprises vanes or tabs, such as vanes 350 shown in FIG. 3. In some embodiments these vanes may be configured to catch wind as it blows and cause the mesh screen to rotate. In such an embodiment, the mesh screen may be part of a mesh assembly comprising bearing surfaces to ease rotation. For example, top ring 310 and bottom ring 340 may comprise bearing surfaces. Further, in such an embodiment, the mesh assembly's rotation may be configured to inhibit insects, birds, lizards, rodents, and/or other animals from constructing nests or other structures in the mesh assembly, or on or around the components of the vent stack cap.

Illustrative Adjustable Fittings

Figure 5:
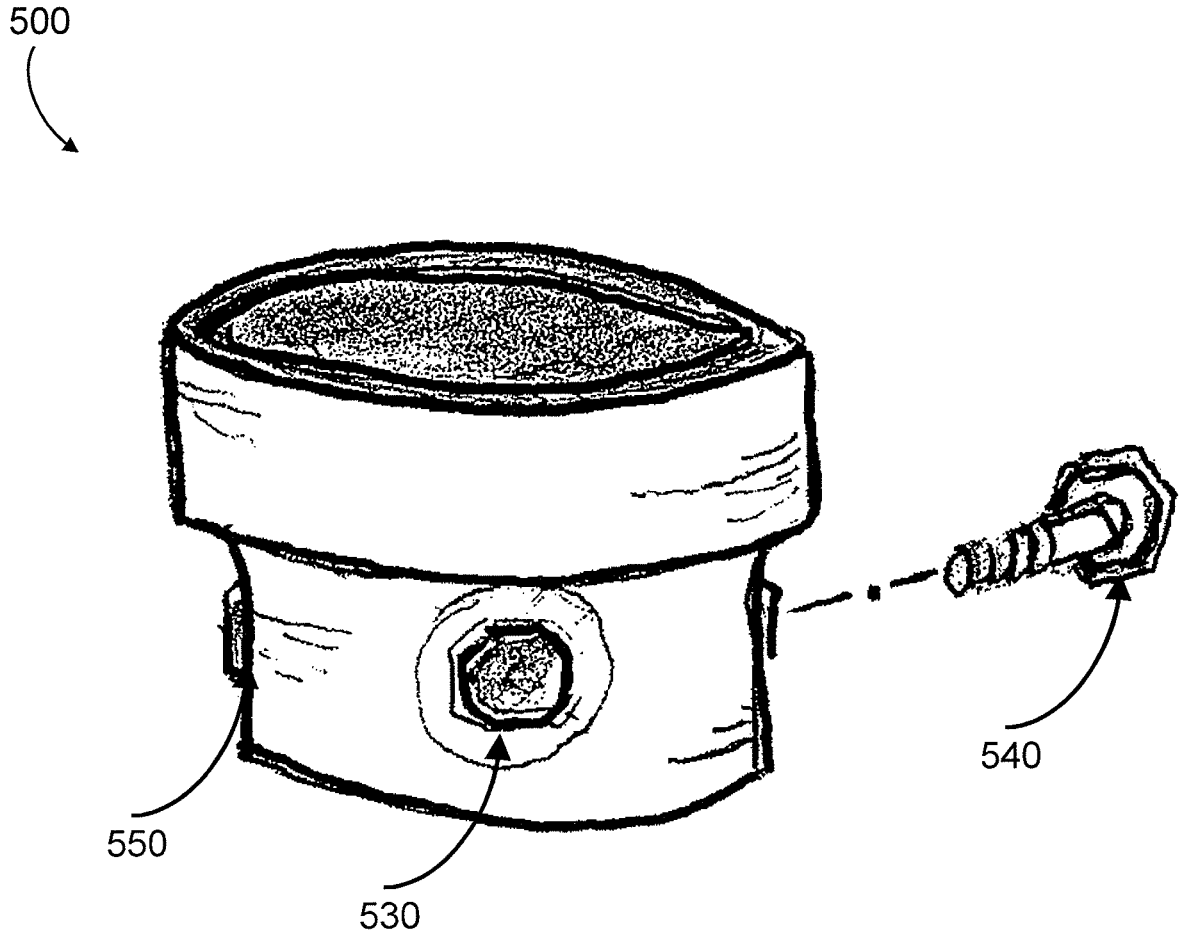
FIG. 5 illustrates an adjustable connector in accordance with an embodiment of the present disclosure.

Referring now to FIG. 5, this figure illustrates an adjustable connector 500 in accordance with an embodiment of the present disclosure. The adjustable connector 500 may be affixed to one or more parts of a vent cap. For example, referring to FIG. 1, the adjustable connector 500 may replace or otherwise be connected with connector fitting 140. In some embodiments, a vent cap—such as vent cap 100—includes an adjustable connector 500. For example, an adjustable connector 500 may be used in conjunction with or in place of connector fitting 140 according to one embodiment. As another example, in some embodiments, an adjustable connector 500 can be used in conjunction with or in place of reduction fitting 250 shown in FIG. 2.

An adjustable connector 500 can be particularly beneficial for installations of a vent cap where the pipe to which the vent cap is to be attached is slightly unstandardized. For example, a standard diameter of connector pipe 140 may be 2", but the pipe to which the vent cap is to be attached may be 2⅛". In this embodiment, an adjustable connector, such as adjustable connector 500 shown in FIG. 5, may be used to install the vent cap. For example, the diameter of the adjustable connector 500 may be a larger dimension than a standard connection fitting. Thus, in some embodiments, the diameter of the adjustable connector 500 may be 2⅛", 2¼", 2½", or any other suitable diameter. In some embodiments, varying materials may have varying outer diameters, but the same inner diameters. For example, in some embodiments, a PVC pipe with a 2" inner diameter may have a different outer diameter than a metal pipe with a 2" inner diameter. In some embodiments, the adjustable connector 500 can then be placed over the unstandardized pipe and tightening bolts, such as screws 530, 540, and 550 can be tightened to provide a snug fit to the unstandardized pipe. Thus, if the adjustable connector 500 has a diameter of 2¼" then the connector could be placed over the unstandardized pipe having a diameter of 2⅛" and tightening bolts can be tightened to provide a fitting with the unstandardized pipe. In one embodiment, the adjustable connector 500 helps to prevent one or more unwanted objects—such as unwanted insects, birds and/or squirrels—from entering a vent stack when the vent cap is coupled to the vent stack.

An adjustable connector 500 can be constructed using any number of materials. In one embodiment, the adjustable connector 500 is made of polyvinyl chloride (PVC). The adjustable connector 500 can be made of acrylonitrile butadiene styrene (ABS), polyvinyl chloride (PVC), glass, metal, other plastic(s), another suitable material, or a combination thereof. Numerous other embodiments are disclosed herein and variations are within the scope of this disclosure.

Figure 6:
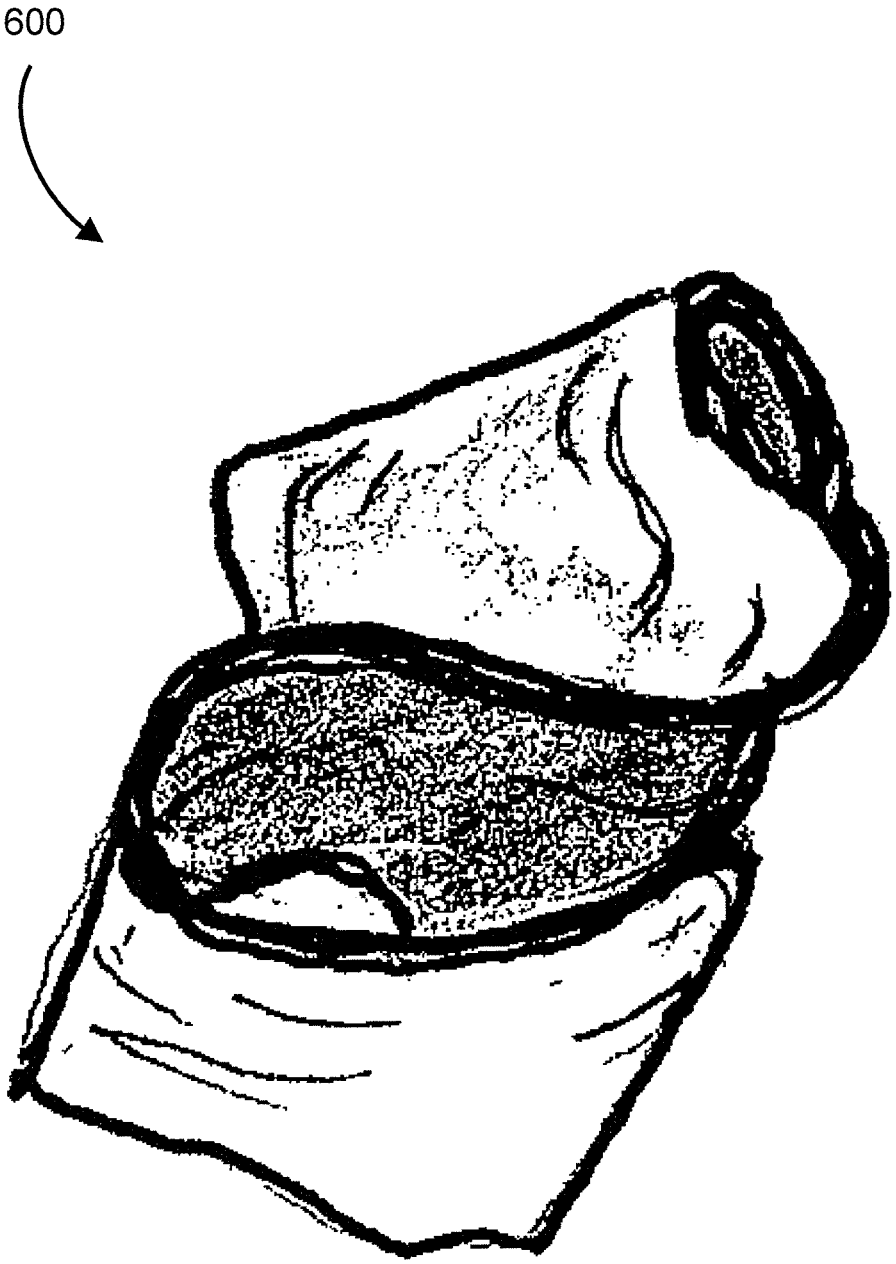
FIG. 6 illustrates an insulating band/spacer in accordance with an embodiment of the present disclosure.

Referring now to FIG. 6, this figure illustrates an insulating band 600 in accordance with an embodiment of the present disclosure. The insulating band 600 may be used with a vent cap, such as vent cap 100 shown in FIG. 1. For example, the insulating band 600 can be placed over or inside a portion of the vent cap 100 and/or a portion of a vent stack to which the vent cap is connected with. The insulating band 600 can be made of any suitable material such as an elastic material, rubber, and/or another stretchable material. The insulating band 600, when installed between a vent cap and/or a vent stack can help to prevent one or more unwanted objects from entering the vent stack. For example, the insulating band 600 may fit snugly against a vent cap and a vent stack to prevent one or more unwanted objects from entering the vent stack. Thus, in some embodiments, the insulating band may act as a gasket or a seal between the vent cap and the vent stack. In some embodiments, insulating band 600 may be used to provide for dielectric coupling, or to prevent two pipes of different material from being bonded. For example, in one embodiment, a vent stack may be made of copper and a vent cap may be made of galvanized pipe. In such an embodiment, insulating band 600 may serve as a barrier between the two metals, and thus reduce the rate of corrosion of the two materials. In some embodiments, connector bolts such as connector bolts 530-550 may be made of any suitable material including, but not limited to, nylon, steel, and/or other materials. In one embodiment, the use of a material such as nylon or another suitable material may help to prevent erosion. Numerous other embodiments are disclosed herein and variations are within the scope of this disclosure.

General

The foregoing description of some embodiments of the disclosure has been presented only for the purpose of illustration and description and is not intended to be exhaustive or to limit the disclosure to the precise fauns disclosed. Numerous modifications and adaptations thereof will be apparent to those skilled in the art without departing from the spirit and scope of the disclosure.

Reference herein to "one embodiment" or "an embodiment" means that a particular feature, structure, operation, or other characteristic described in connection with the embodiment may be included in at least one implementation of the disclosure. The disclosure is not restricted to the particular embodiments described as such. The appearance of the phrase "in one embodiment" or "in an embodiment" in various places in the specification does not necessarily refer to the same embodiment. Any particular feature, structure, operation, or other characteristic described in this specification in relation to "one embodiment" may be combined with other features, structures, operations, or other characteristics described in respect of any other embodiment.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Having described several example configurations, various modifications, alternative constructions, and equivalents may be used without departing from the spirit of the disclosure. For example, the above elements may be components of a larger system, wherein other rules may take precedence over or otherwise modify the application of the disclosure. Also, a number of steps may be undertaken before, during, or after the above elements are considered. Accordingly, the above description does not bound the scope of the claims.

The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Headings, lists, and numbering included herein are for ease of explanation only and are not meant to be limiting.

While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, it should be understood that the present disclosure has been presented for purposes of example rather than limitation, and does not preclude inclusion of such modifications, variations and/or additions to the present subject matter as would be readily apparent to one of ordinary skill in the art.

That which is claimed is:

1. A vent cap comprising:

a hollow tube comprising a side wall defining at least one airway;

a cap coupled to a first end of the hollow tube, the cap configured to deter one or more unwanted objects from entering the hollow tube through the first end, wherein a second end of the hollow tube is configured to be affixed with a vent stack, the second end opposite the first end;

a reduction fitting firmly affixed to the second end of the hollow tube such that the reduction fitting cannot move relative to the hollow tube, the reduction fitting configured to be affixed to the vent stack, wherein the vent stack comprises a vent for a plumbing system, and wherein one or more of the hollow tube, the cap, or the reduction fitting comprises a texture configured to allow paint to easily adhere to one or more surfaces; and a mesh material covering the at least one airway, the mesh material configured to allow air to pass through the at least one airway, the mesh material configured to deter the one or more unwanted objects from entering the hollow tube through the at least one airway, wherein the mesh material comprises a pesticide treatment.

2. The vent cap of claim 1, wherein an area of the at least one airway is substantially equal to an area of an opening of the vent stack.

3. The vent cap of claim 1, wherein an area of the at least one airway is configured to be of a size such that after subtracting an area of the mesh material a remaining area is greater than or equal to the area of an opening of the vent stack.

4. The vent cap of claim 1, wherein the vent cap is configured to deter the one or more unwanted objects from entering the vent stack when the second end of the hollow tube is affixed to the vent stack.

5. The vent cap of claim 1, wherein a diameter of the hollow tube is greater than or equal to a diameter of the vent stack.

6. The vent cap of claim 1, further comprising: an adjustable connector configured for affixing the second end of the hollow tube to the vent stack, wherein the adjustable connector is configured for accommodating vent stacks having varying outside diameters, and wherein the adjustable connector is configured to deter the one or more unwanted objects from entering the hollow tube through the second end of the hollow tube when affixed to the vent stack.

7. The vent cap of claim 1, wherein the one or more unwanted objects comprises at least one of an insect, bird, snake, lizard, rodent, garbage, bottle, leaf, can, cigarette butt, or rock.

8. The vent cap of claim 1, wherein the hollow tube, vent cap, and mesh comprise a single molded piece.

9. The vent cap of claim 1, wherein the hollow tube comprises a hollow cylinder.

10. The vent cap of claim 1, wherein a perimeter of the cap comprises a curved lip.

11. The vent cap of claim 1, wherein the mesh material comprises a mesh insert, the mesh insert configured to be inserted into the hollow tube.

12. The vent cap of claim 1, wherein the hollow tube comprises a plurality of airways, each airway being dimensionally spaced about the side wall.

13. The vent cap of claim 1, wherein:

the hollow tube comprises a plurality of airways, the mesh material comprises a plurality of mesh inserts; and each mesh insert covers a respective one of the plurality of airways.

14. The vent cap of claim 1, wherein the hollow tube and the cap comprise at least one of polyvinyl chloride (PVC) or acrylonitrile butadiene styrene (ABS).

15. The vent cap of claim 1, wherein the at least one airway comprises a shape configured to resist development of insect nests.

16. The vent cap of claim 1, wherein the mesh material comprises a mesh assembly comprising a bearing mechanism configured to allow the mesh assembly to rotate in the hollow tube.

17. A system comprising:

a vent stack having an airway of a first area; and a vent cap comprising:

a hollow tube comprising a first end, a second end opposite the first end, and a side wall defining at least one airway of a second area;

a cap coupled to the first end of the hollow tube; and a mesh material covering the at least one airway, wherein the cap is configured to deter one or more objects from entering the hollow tube through the first end, wherein the mesh material is configured to allow air to pass through the at least one airway, wherein the mesh material is configured to deter the one or more objects from entering the hollow tube through the at least one airway, wherein the mesh material comprises a pesticide treatment, wherein the second end of the vent cap is configured to be firmly affixed to the vent stack such that the vent cap cannot move relative to the vent stack, wherein the second area is greater than or equal to the first area, wherein the vent stack comprises a vent for a plumbing system, and wherein one or more of the hollow tube, the cap, or a reduction fitting comprises a texture configured to allow paint to easily adhere to one or more surfaces, and wherein the vent cap is configured to deter the one or more objects from entering the vent stack when the second end of the hollow tube is affixed to the vent stack.

18. The vent cap of claim 1, wherein one or more of the hollow tube, the cap, or the reduction fitting comprises are constructed from a UV-inhibitor resistant material.

* * * * *